US010164365B2

(12) United States Patent
Hashiguchi

(10) Patent No.: US 10,164,365 B2
(45) Date of Patent: Dec. 25, 2018

(54) FEMALE TERMINAL AND CONNECTOR INCLUDING FEMALE TERMINAL

(71) Applicant: JAPAN AVIATION ELECTRONICS INDUSTRY, LIMITED, Shibuyaku, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 34 days.

(21) Appl. No.: 15/640,872

(22) Filed: Jul. 3, 2017

(65) Prior Publication Data

US 2018/0034179 A1 Feb. 1, 2018

(30) Foreign Application Priority Data

Aug. 1, 2016 (JP) ..... 2016-150937

(51) Int. Cl.

| | |
|---|---|
| ***H01R 13/11*** | (2006.01) |
| ***H01R 13/187*** | (2006.01) |
| ***H01R 13/115*** | (2006.01) |
| *H01R 4/18* | (2006.01) |
| *H01R 12/51* | (2011.01) |
| *H01R 13/627* | (2006.01) |

(52) U.S. Cl.

CPC ..... *H01R 13/113* (2013.01); *H01R 13/115* (2013.01); *H01R 13/187* (2013.01); *H01R 4/185* (2013.01); *H01R 12/515* (2013.01); *H01R 13/6272* (2013.01)

(58) Field of Classification Search

CPC ..... H01R 4/185; H01R 13/05; H01R 13/15; H01R 13/10; H01R 13/113; H01R 13/187; H01R 13/2492

USPC ..... 439/839, 841, 843, 845, 850, 851, 852, 439/856, 867

See application file for complete search history.

(56) References Cited

U.S. PATENT DOCUMENTS

| | | | | |
|---|---|---|---|---|
| 4,919,628 A * | 4/1990 | Mobley | ..... | H01R 13/113 439/852 |
| 6,547,608 B2 * | 4/2003 | Sato | ..... | H01R 13/11 439/851 |
| 8,021,200 B2 * | 9/2011 | Myer | ..... | H01R 13/113 439/857 |

(Continued)

FOREIGN PATENT DOCUMENTS

JP 2002063961 A 2/2002

*Primary Examiner* — Tulsidas C Patel
*Assistant Examiner* — Travis Chambers
(74) *Attorney, Agent, or Firm* — Holtz, Holtz & Volek PC

(57) ABSTRACT

A female terminal downsized in a male terminal-inserting direction. A terminal body has a reception portion, for receiving a male terminal. A first and second spring portions are arranged to be opposed to each other so as to sandwich the male terminal inserted into the reception portion from an inlet portion thereof. The first spring portion has a first and second contact points brought into contact with the sale terminal in the reception portion. The second spring portion has a third contact point brought into contact with the stale terminal in the reception portion. The third contact point is between the first and second, contact points in the male terminal-inserting direction. The first contact point is in the inlet portion of the reception portion, and the second contact point is at a more inward location in the reception portion than the first contact point.

16 Claims, 15 Drawing Sheets

(56) References Cited

U.S. PATENT DOCUMENTS

| | | | | |
|---|---|---|---|---|
| 8,668,531 | B2 * | 3/2014 | Yamaguchi | H01R 13/187 439/843 |
| 8,827,754 | B2 * | 9/2014 | Lee | H01R 13/113 439/843 |
| 8,827,756 | B2 * | 9/2014 | Mueller | H01R 13/112 439/852 |
| 9,017,113 | B2 * | 4/2015 | Haga | H01R 13/03 439/816 |
| 9,088,115 | B2 * | 7/2015 | Komoto | H01R 12/774 |
| 9,099,796 | B2 * | 8/2015 | Myer | H01R 13/113 |
| 9,515,396 | B2 * | 12/2016 | Chikusa | H01R 13/113 |
| 9,735,490 | B2 * | 8/2017 | Wu | H01R 13/24 |
| 9,748,685 | B2 * | 8/2017 | Oba | H01R 13/187 |
| 9,837,745 | B2 * | 12/2017 | Sasaki | H01R 13/113 |
| 2004/0224573 | A1 * | 11/2004 | Yoshida | H01R 13/11 439/852 |

* cited by examiner

FEMALE TERMINAL AND CONNECTOR INCLUDING FEMALE TERMINAL

BACKGROUND OF THE INVENTION

Field of the Invention

This invention relates to a female terminal and a connector including the female terminal.

Description of the Related Art

Conventionally as shown in FIG. 14, there has been known a female terminal 901D including a pair of elastic contact pieces 903D and 903D', arranged to be opposed to each other so as to sandwich a male terminal (not shown) inserted in an accommodating chamber 900R (see Japanese Laid-open Patent Publication (Kokai) No. 2002-63961). The following description is given of the conventional female terminal.

One elastic contact piece 903D is formed to be extended from a bottom plate 908D of the female terminal 901D to a free end 912D via a bent portion 911D. Two contact points AD1 and AD2 are formed on this elastic contact piece 903D.

The other elastic contact piece 903D' is formed to be extended from a top plate 907D of the female terminal 901D to a free end 912D' via a bent portion 911D'. One contact point BD is formed on this elastic contact piece 903D'.

The contact point BD of the elastic contact piece 903D' is at a location between the contact points AD1 and AD2 in a male terminal-inserting direction 900E.

When a male terminal is inserted in accommodating chamber 900R, the male terminal is sandwiched between both of the elastic contact pieces 903D and 903D'. At this time, returning forces of the elastic contact pieces 903D and 903D' act to hold the male terminal at the three points of the contact points AD1 and AD2 and the contact point BD in a sandwiching scanner.

When the male terminal is inserted between the elastic contact pieces 903D and 903D', a relationship in which the contact points AD1 and AD2 and the contact point BD are at three corners of a triangle, respectively, is established, and hence the male terminal is stably held by the elastic contact pieces 903D and 903D' in a sandwiched manner.

Therefore, it is observed that a contact stability between the male terminal and the elastic contact pieces 903D and 903D' is obtained, whereby stable electrical connection between the male terminal and the female terminal 901D is ensured.

However, the above-described female terminal 901D has a problem that due to its structure, the elastic contact piece 903D is formed to be long, and hence the dimension of the female terminal 901D in the male terminal-inserting direction 900E is increased accordingly.

SUMMARY OF THE INVENTION

The present invention has been made in view of these circumstances, and an object thereof is to realize downsizing of a female terminal and a connector including the female terminal in a male terminal-inserting direction.

To attain the above object, in a first aspect of the present invention, there is provided a female terminal comprising a terminal body having a reception portion for receiving a male terminal, and a first spring portion and a second spring portion that are formed on the terminal body, and are arranged to be opposed to each other so as to sandwich the male terminal inserted from an inlet portion of the reception portion into the reception portion, wherein the first spring portion includes a first linking portion which is continuous with a reception portion inlet-side end portion of the terminal body, and is bent from the reception portion inlet-side end portion toward the reception portion, and a first contact point and a second contact point which are brought into contact with the male terminal inserted in the reception portion, wherein the second spring portion includes a second linking portion which is continuous with the reception portion inlet-side end portion of the terminal body, and is bent from the reception portion inlet-side end portion toward the reception portion, and a third contact point which is brought into contact with the male terminal inserted in the reception portion, wherein the third contact point is at a location between the first contact point and the second contact point in a male terminal-inserting direction, wherein the first contact point is a location in the inlet portion of the reception portion, and wherein the second contact point is at a more inward location in the receiving portion than the first contact point.

Preferably, the second contact point is at a location closer to the second spring portion than the first contact point in a spring portion-opposed direction in which the first spring portion and the second spring portion are opposed to each other.

Preferably, the first spring portion includes a first spring body which is continuous with the first linking portion, and extends in the male terminal-inserting direction, the second spring portion includes a second spring body which is continuous with the second linking portion, and extends in the sale terminal-inserting direction, the first contact point is formed on the first linking portion, the second contact point is formed on the first spring body, and the third contact point is formed on the second spring body.

More preferably, the first linking portion has an arc shape.

More preferably, the first spring body includes a first straight portion which is continuous with the first linking portion, a carved portion which is continuous with the first straight portion, and a second straight portion which is continuous with the curved portion, and the curved portion is at a location farther from the second spring portion than the first straight portion and the second straight portion in the spring portion-opposed direction.

Preferably, the female terminal further comprises a first auxiliary spring portion that is formed on the terminal body, and is capable of supporting the first spring portion from a surface of the first spring portion, opposite from a surface which is brought into contact with the male terminal, and a second auxiliary spring portion that is formed on the terminal body, and is capable of supporting the second spring portion from a surface of the second spring portion, opposite from a surface which is brought into contact with the male terminal.

Preferably, the female terminal is formed of one metal plate.

To attain the above object, in a second aspect of the present invention, there is provided a connector including a female terminal comprising a terminal body having a reception portion for receiving a male terminal, and a first spring portion and a second spring portion that are formed on the terminal body, and are arranged to be opposed to each other so as to sandwich the male terminal inserted from an inlet portion of the reception portion into the reception portion, wherein the first spring portion includes a first linking portion which is continuous with a reception portion inlet-side end portion of the terminal body, and is bent from the reception portion inlet-side end portion toward the reception portion, and a first contact point and a second contact point which are brought into contact with, the male terminal inserted in the reception portion, wherein, the second spring portion includes a second linking portion which is continuous with the reception portion inlet-side end portion of the terminal body, and is bent from the reception portion inlet-side end portion toward the reception portion, and a third contact point which is brought into contact with the male terminal inserted in the reception portion, wherein the third contact point is at a location between the first contact point and the second contact point in a male terminal-inserting direction, wherein the first contact point is a location in the inlet portion of the reception portion, and wherein the second contact point is at a more inward location in the receiving portion than the first contact point, and a housing that holds the female terminal.

According to the present invention, it is possible to realize downsizing of the female terminal and the connector including the female terminal in the male terminal-inserting direction.

The above and other objects, features and advantages of the present invention will become more apparent from the following detailed description taken in conjunction with the accompanying drawings.

DETAILED DESCRIPTION OF THE PREFERRED EMBODIMENT

Figure 1:
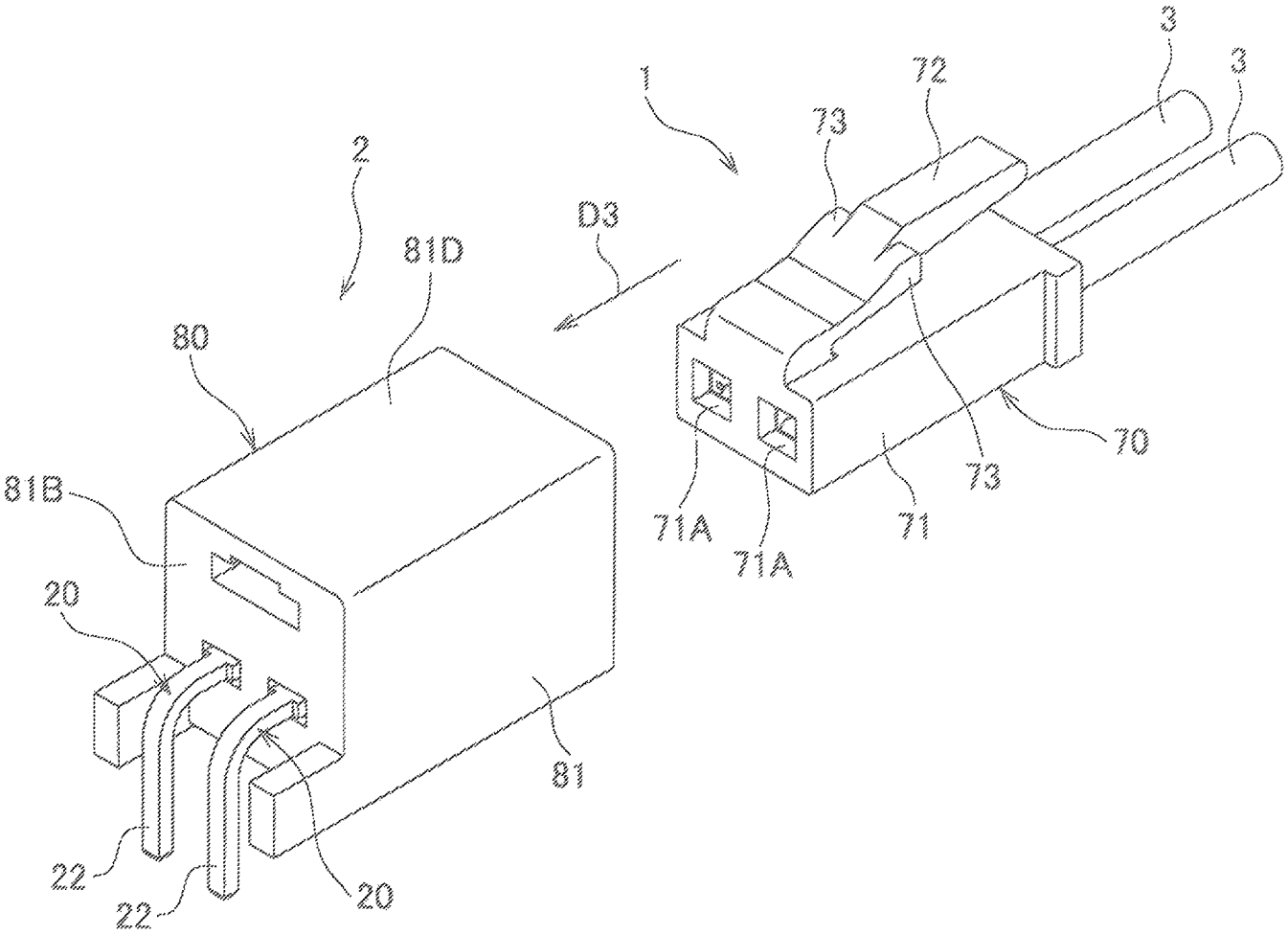
FIG. 1 is a perspective view of a ping connector according to an embodiment of the present invention and a receptacle connector in a state before fitting the plug connector to the receptacle connector.

The present invention will now be described in detail with reference to the drawings showing preferred embodiments thereof.

A plug connector (connector) 1 according to an embodiment of the present invention can be fitted to a receptacle connector 2, as shown in FIGS. 1 to 3, and 5 to 7.

Cables 3 are connected to the plug connector 1. The plug connector 1 includes female terminals 10 (see FIGS. 8 to 13) according to the embodiment of the present invention, and a housing 70 that holds the female terminals 10.

The housing 70 is formed of an insulating material (e.g. a synthetic resin), and has elasticity. The housing 70 includes a housing body 71, a spring portion 72, and protruding portions 73.

The housing body 71 has two contact accommodation portions 711 for accommodating the female terminals 10, respectively. Each contact accommodation portion 711 extends in a plug connector-fitting direction D3.

One end of the spring portion 72 is connected to an end of the housing body 71, which is formed with male terminal receiving inlets 71A. The spring portion 72 extends in the plug connector-fitting direction D3.

Figure 2:
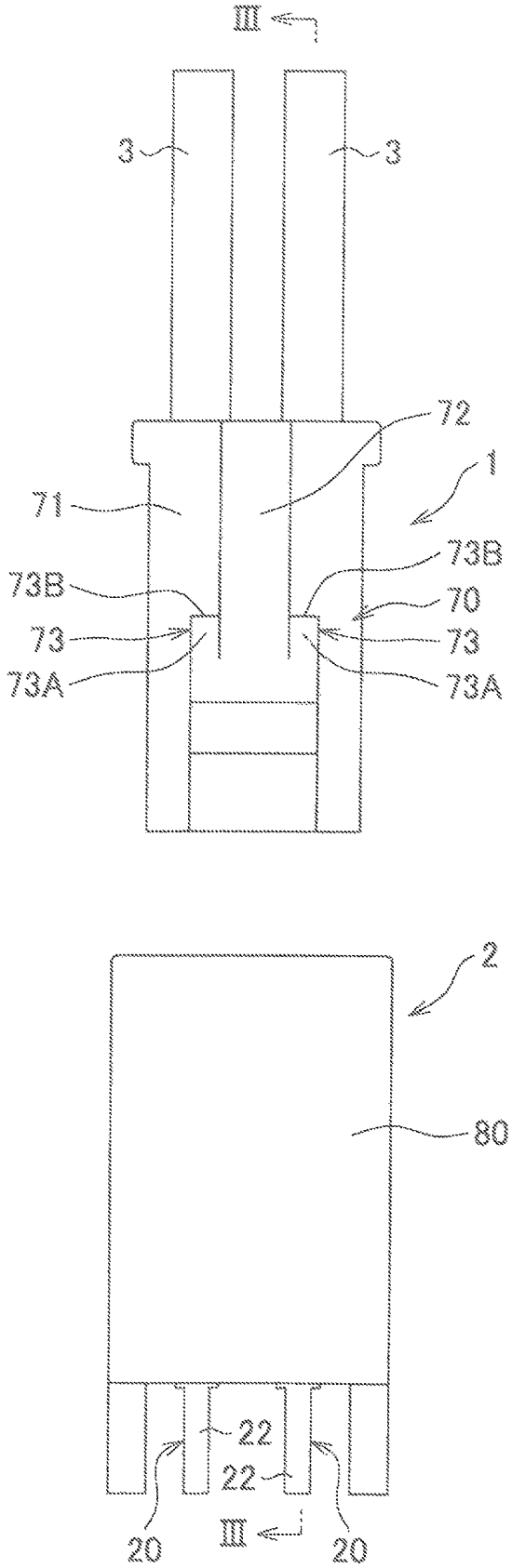
FIG. 2 is a plan view of the plug connector and the receptacle connector, shown in FIG. 1.

The spring portion 72 has opposite sides each formed with the protruding portion 73 (see FIGS. 1 and 2). The two protruding portions 73 are at respective locations in a substantially intermediate portion of the spring portion 72 in the ping connector-fitting direction D3. Each protruding portion 73 has an upper portion formed with an inclined surface 73A, and a rear portion formed with a vertical surface 73B (see FIGS. 2 and 3).

The receptacle connector 2 is mounted on a printed circuit board, not shown. The receptacle connector 2 includes two male terminals 20, and a housing 80 that holds the two male terminals 20.

Figure 3:
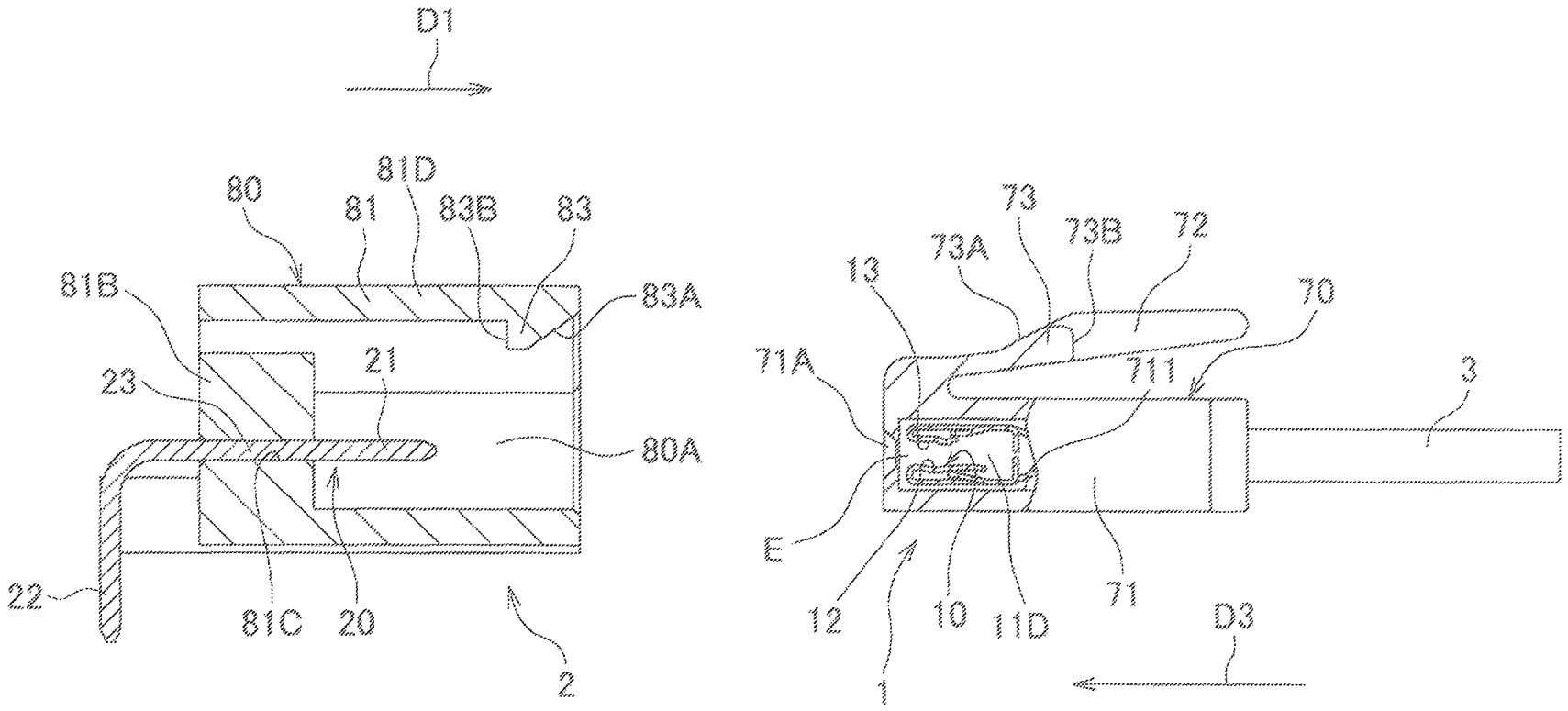
FIG. 3 is a cross-sectional view taken along III-III of FIG. 2, in which the plug connector is partly broken away.

The housing 80 has a connector accommodation portion 80A that accommodates the plug connector 1 (see FIG. 3). The connector accommodation portion 80A extends in a male terminal-inserting direction D1.

The housing 80 is formed of an insulating material (e.g. a synthetic resin), and has elasticity. The housing 80 includes a housing body 81 and a protruding portion 83.

Figure 7:
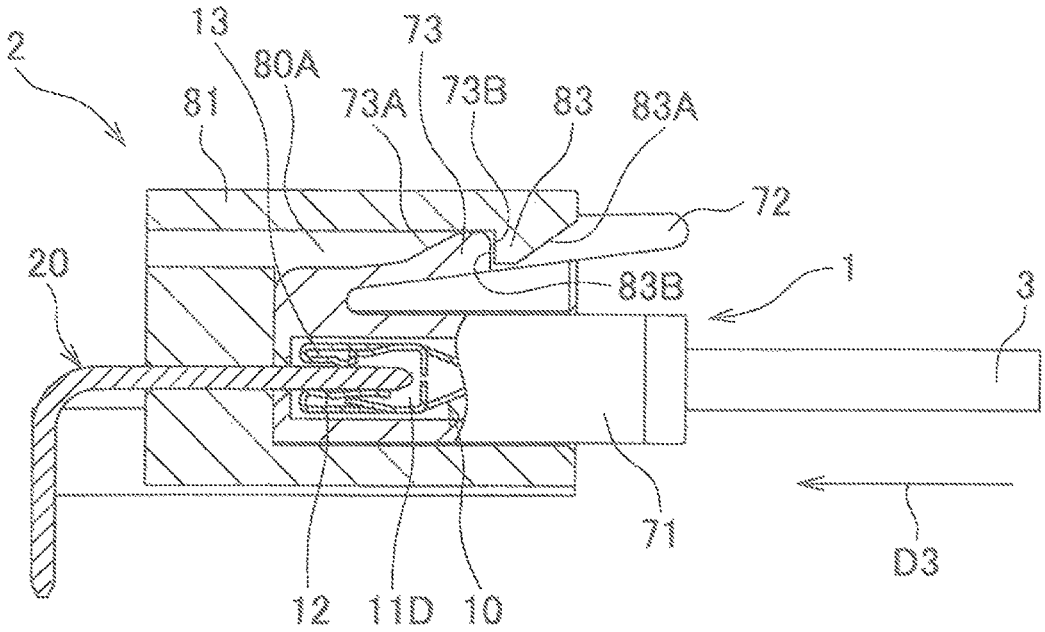
FIG. 7 is a cross-sectional view taken along VII-VII of FIG. 6, in which the plug connector is partly broken away.
Figure 8:
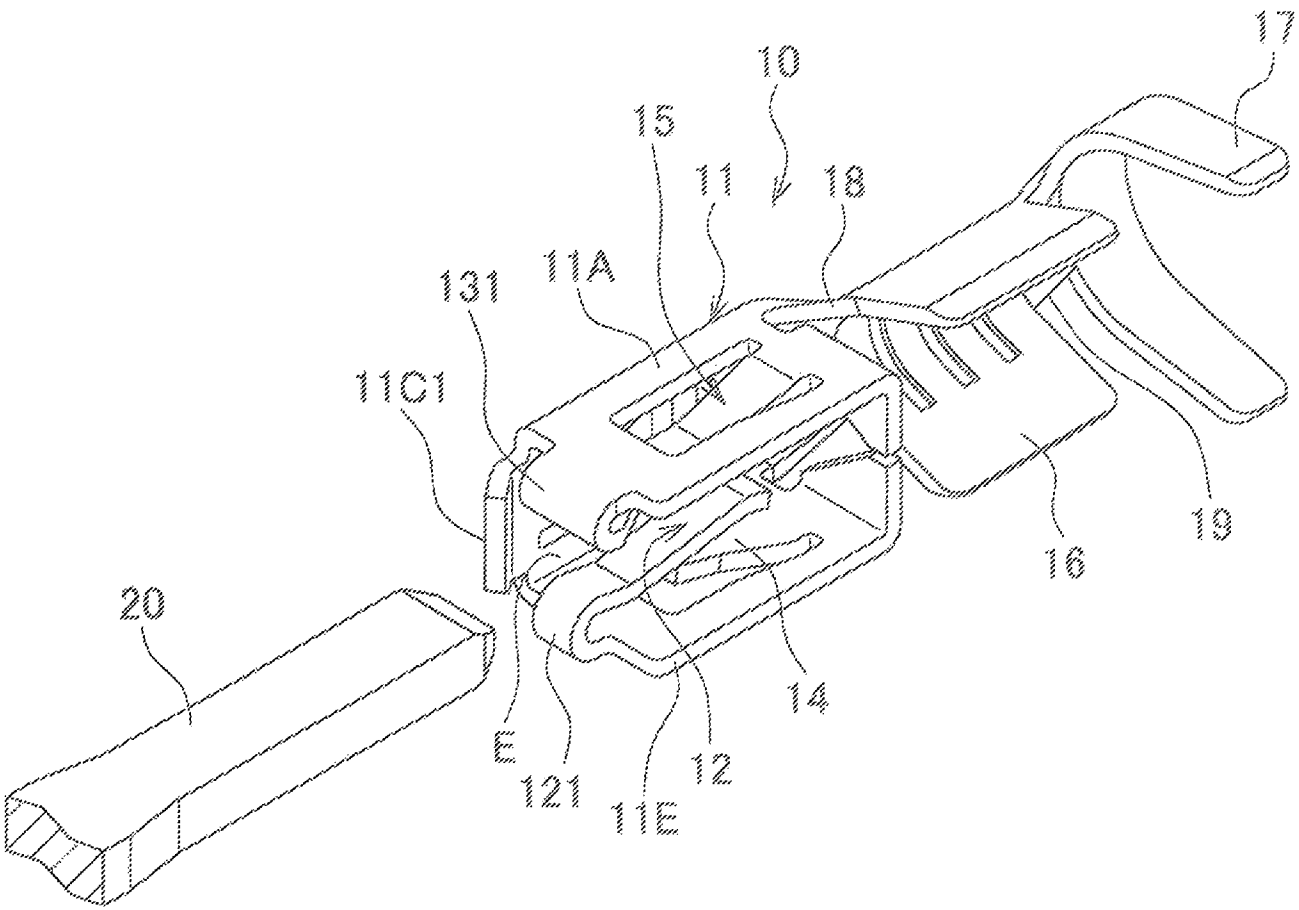
FIG. 8 is a perspective view of a female terminal according to the embodiment of the present invention and a male terminal in a state before fitting the female terminal to the male terminal.
Figure 9:
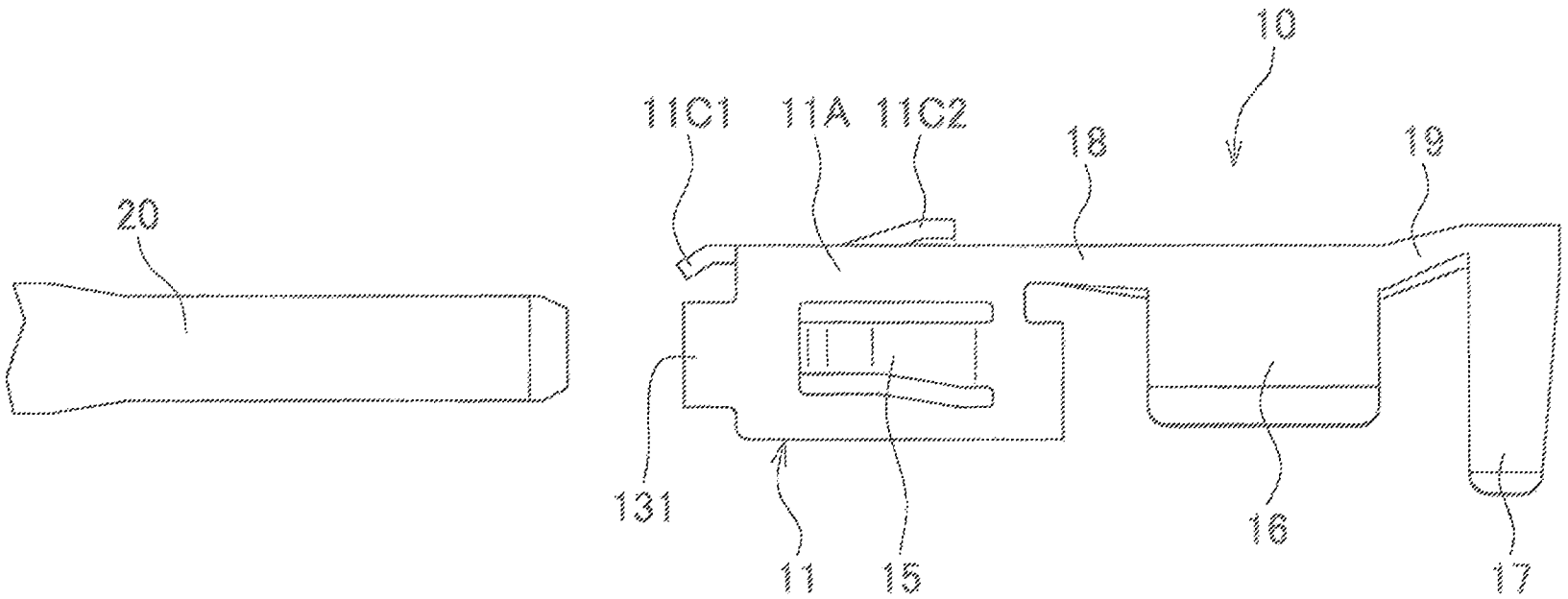
FIG. 9 is a plan view of the female terminal and the male terminal, shown in FIG. 8.

The housing body 81 has a rear wall portion 81B formed with two press-in holes 81C (only one press-in hole 81C appears in FIGS. 3 and 7).

The protruding portion 83 is formed on an inner surface of a top-side portion 81D of the housing body 81 (see FIG. 3). The protruding portion 83 is at a location toward a front end of the housing body 81 in the males terminal-inserting direction D1. The protruding portion 83 has a front portion formed with an inclined surface 83A, and a rear portion formed with a vertical surface 83B (see FIGS. 3 and 7).

Figure 4:
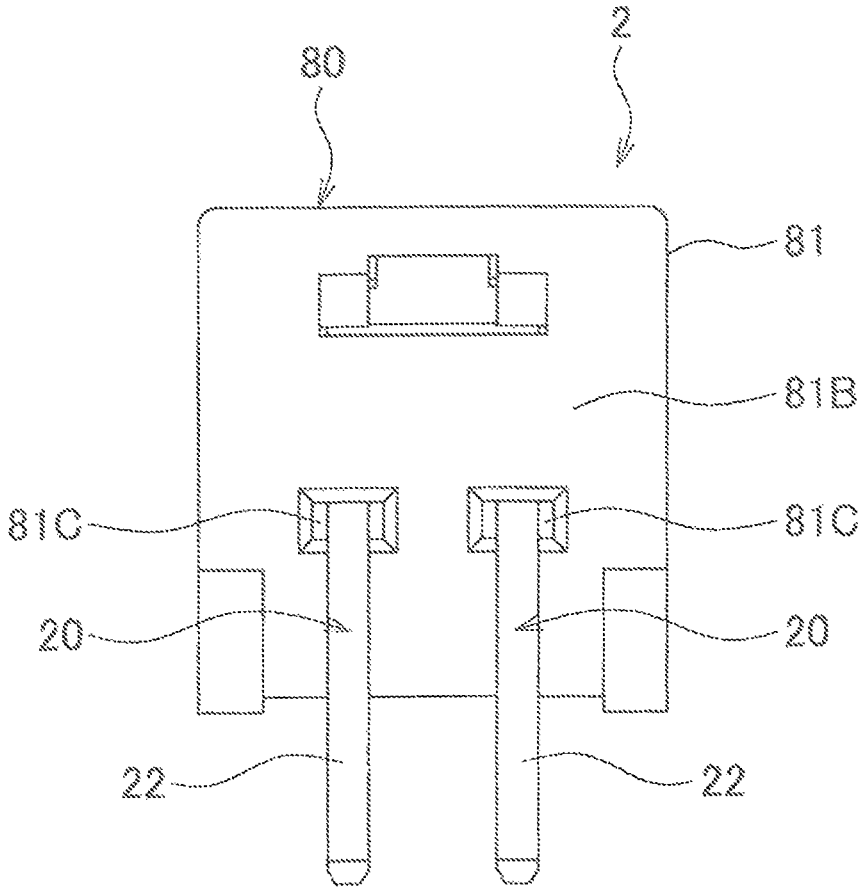
FIG. 4 is a rear view of the receptacle connector appearing in FIG. 1.
Figure 5:
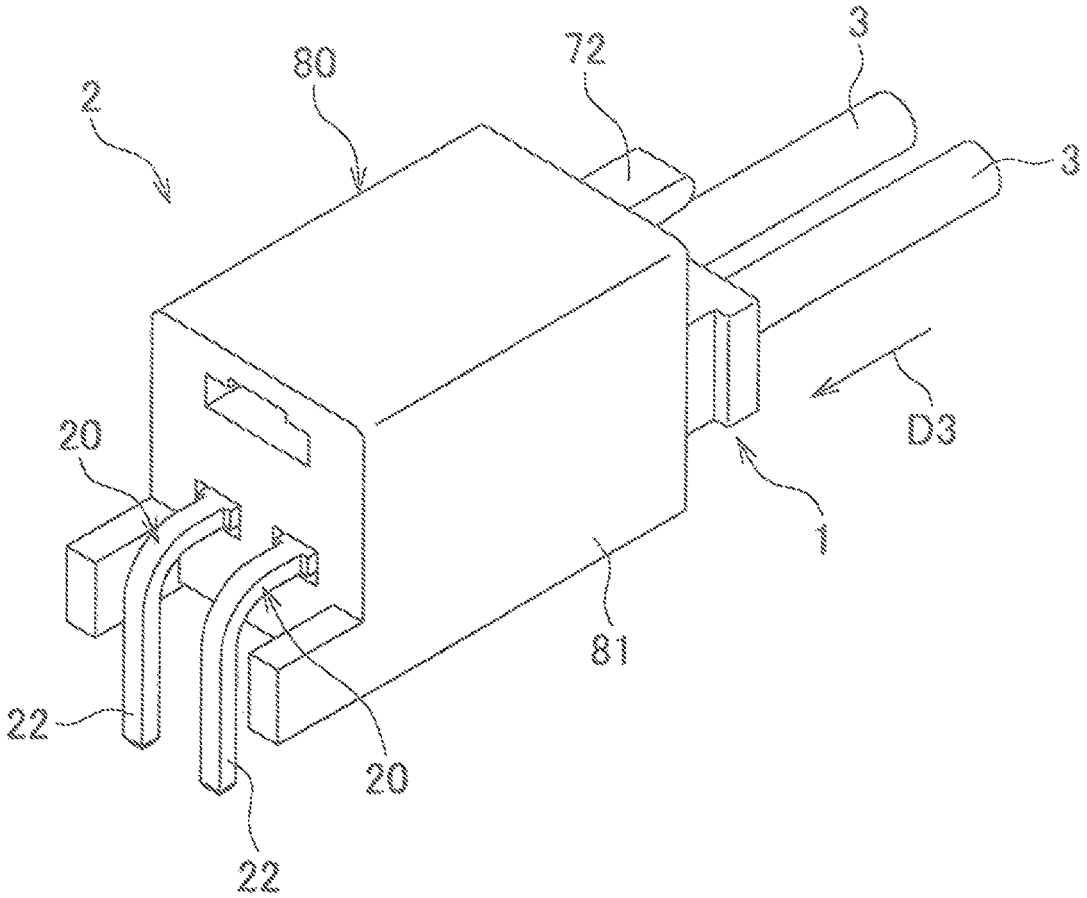
FIG. 5 is a perspective view of the plug connector and the receptacle connector, shown in FIG. 1, in a state in which the plug connector is fitted to the receptacle connector.
Figure 6:
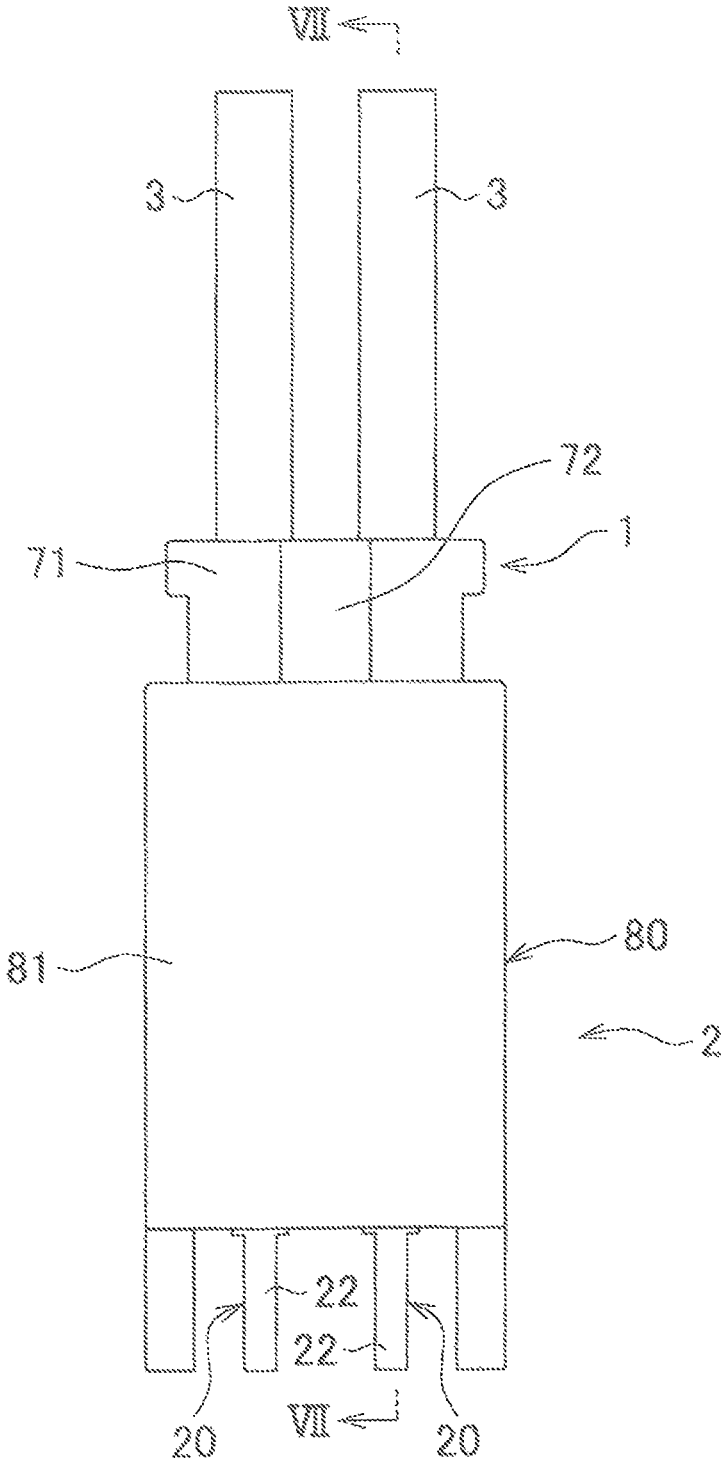
FIG. 6 is a plan view of the plug connector and the receptacle connector, shown in FIG. 5.

Each male terminal 20 includes a contact portion 21, a connection portion 22, and a linking portion 23 (see FIG. 3). The contact portion 21 can be brought into contact with the female terminal 10 of the plug connector 1. The connection portion 22 is inserted in and soldered to a through hole (not shown) of the printed circuit board. The linking portion 23 is bent into an L-shape, and connects the contact portion 21 and the connection portion 22. The linking portion 23 is press-fitted in an associated one of the press-in holes 81C of the rear wall portion 81B as shown in FIGS. 3 and 4, whereby the male terminal 20 is held by the housing body 81.

As shown in FIGS. 8 to 13, each female terminal 10 is formed by blanking and bending one metal plate. The female terminal 10 includes a terminal body 11, a first spring portion 12, a second spring portion 13, a crimping portion 16, a cover holding portion 17, a linking portion 18, and a linking portion 19.

Figure 10:
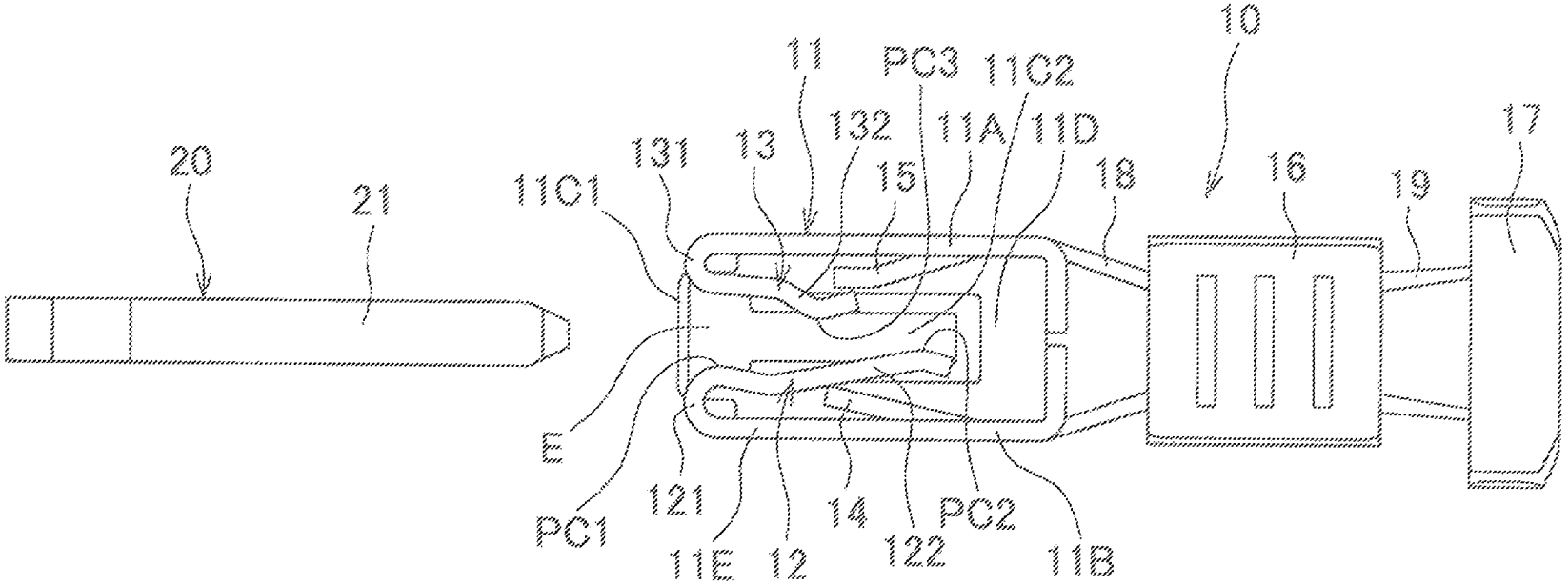
FIG. 10 is a side view of the female terminal and the male terminal, shown in FIG. 8.
Figure 12:
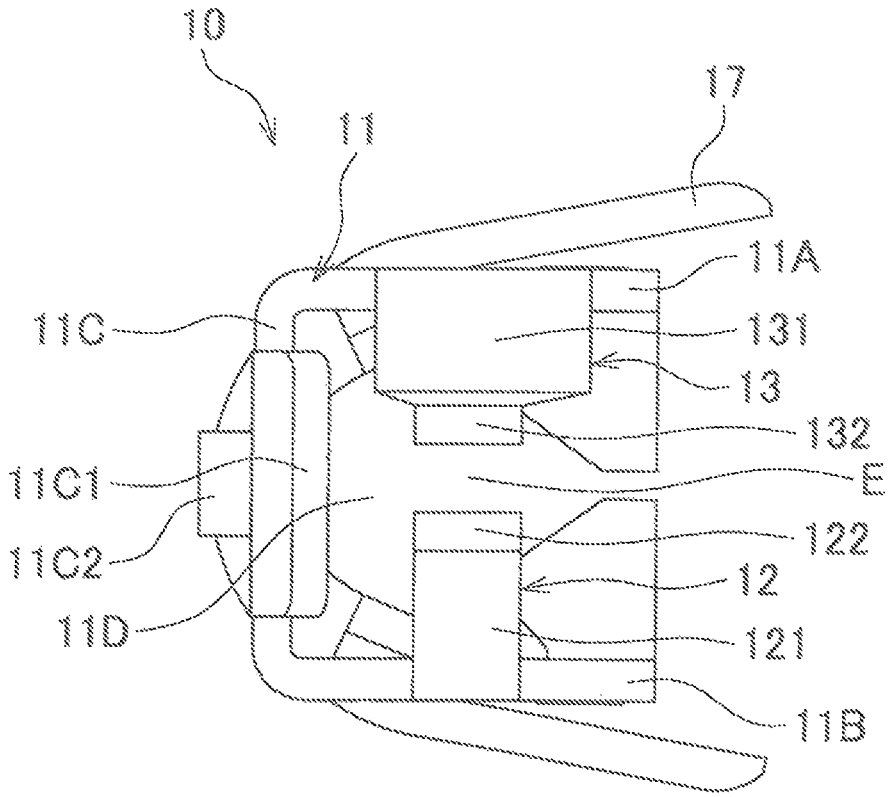
FIG. 12 is a front view of the female terminal appearing in FIG. 8.

As shown in FIGS. 10 and 12, the terminal body 11 has a top-side portion 11A, a bottom-side portion 11B opposed to the top-side portion 11A, a side portion 11C that connects one of lateral ends of the top-side portion 11A and one of lateral ends of the bottom-side portion 11B, and a receiving portion 11D for receiving the stale terminal 20. The receiving portion 11D is a space formed by the top-side portion 11A, the bottom-side portion 11B, and the side portion 11C, for receiving therein the male terminal 20.

The side portion 11C is formed with a protruding portion 11C1 that functions as a guide when the female terminal 10 is accommodated into the accommodation portion 711 (see FIG. 3) of the housing 70, and a lance 11C2 for holding the female terminal 10 accommodated in the accommodation portion 711 of the housing 70 in the housing body 71 of the housing 70.

The cover holding portion 17 is a portion that is crimped to hold the cable 3 together with its cover. When the cable 3 is not held by the cover holding portion 17, the cross section of the cover holding portion 17 is substantially U-shaped (see FIGS. 8 and 12). The crimping portion 16 is a portion that is crimped to hold a plurality of conductors (not shows) of the cable 3. When the conductors of the cable 3 are not held by the crimping portion 16, the cross section of the crimping portion 16 is substantially U-shaped (see FIG. 8. The linking portion 18 is a portion that links the crimping portion 16 to the terminal body 11. The linking portion 19 is a portion that links the cover holding portion 17 to the crimping portion 16.

The first spring portion 12 and the second spring portion 13 are arranged to be opposed to each other so as to sandwich the mala terminal 20 inserted from an inlet portion E (hatched area in FIG. 11B) of the receiving portion 11D into the receiving portion 11D.

As shown in FIGS. 10, 11A, 11B, and 13, the first spring portion 12 includes a first contact point PC1 and a second contact point PC2 which are brought into contact with the contact portion 21 of the male terminal 20 inserted in the receiving portion 11D.

The second spring portion 13 includes a third contact point PC3 which is brought into contact with the contact portion 21 of the male terminal 20 inserted in the receiving portion 11D.

The third contact point PC3 is at a location between the first contact point PC1 and the second contact point PC2 in the male terminal-inserting direction D1.

Figure 11A:
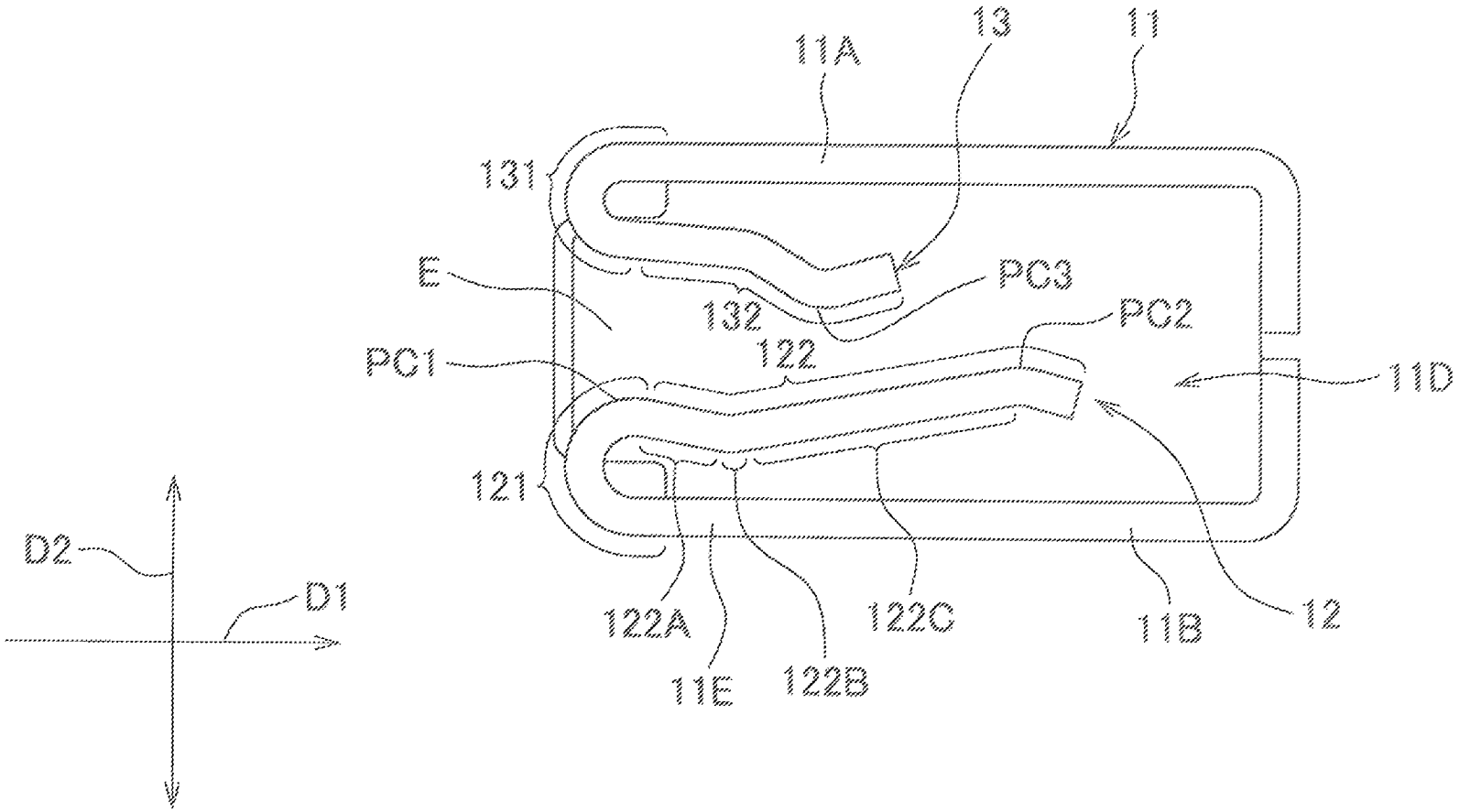
FIG. 11A is a conceptual view useful in explaining a first spring portion, a second spring portion, and a terminal body, of the female terminal appearing in FIG. 8 (note that a first auxiliary spring portion, a second ancillary spring portion, and a lance are omitted)
Figure 11B:
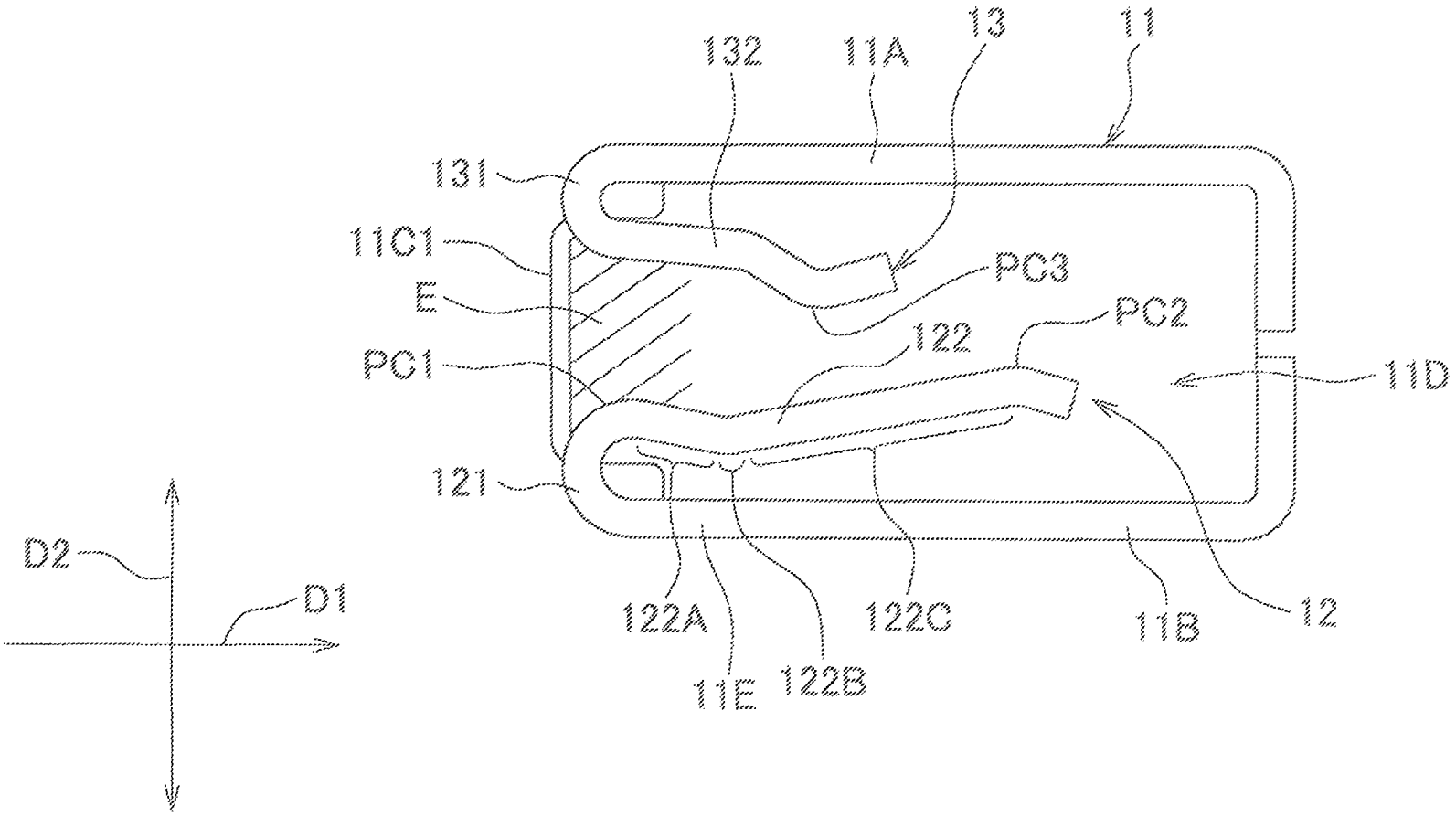
FIG. 11B is a conceptual view useful in explaining the first spring portion, the second spring portion, and the terminal body, of the female terminal, appearing in FIG. 8, and for clearly showing an inlet part of a receiving portion.

The first contact point PC1 is at a location in the inlet portion E of the receiving portion 11D, and the second contact point PC2 is at a more inward location in the receiving portion 11D than the first contact point PC1 (see FIG. 11B).

The second contact point PC2 is at a location closer to the second spring portion 13 than the first contact point PC1 in a spring portion-opposed direction D2 (see FIG. 11A).

The first spring portion 12 includes a first linking portion 121 which Is continuous with a receiving inlet-side end portion 11E of the terminal body 11, and a first spring body 122 which is continuous with the first linking portion 121.

The first linking portion 121 is a portion which is bent in a manner drawing an arc from the receiving inlet-side end portion 11E toward the receiving portion 11D. The first linking portion 121 has an arc shape as viewed from the side thereof (see FIG. 10). The arc shape here is not limited to an arc in the strict sense, but includes an arc shape in which most part of the first linking portion 121 is formed into an arc. For example, an arc shape in which at least one of opposite ends is formed to extend straight, and an arc shape in which an intermediate portion is formed to extend straight are included in the arc shape mentioned here. In the present embodiment, the first spring body 122 is smoothly continuous with one end of the arc drawn by the first linking portion 121.

The first spring body 122 extends in the male terminal-inserting direction D1.

The second spring portion 13 includes a second linking portion 131 which is continuous with the receiving inlet-side end portion HE of the terminal body 11, and a second spring body 132 which is continuous with the second linking portion 131.

The second linking portion 131 is a portion which is bent in a manner drawing an arc from the receiving inlet-side end portion 11E of the terminal body 11 toward the receiving portion 11D. The second linking portion 131 has an arc shape, as viewed from the side thereof (see FIG. 10).

The second spring body 132 extends in the male terminal-inserting direction D1.

The first contact point PC1 is formed on the first linking portion 121, the second contact point PC2 is formed on the first spring body 122, and the third contact point PC3 is formed on the second spring body 132.

The first spring body 122 includes a first straight portion 122A which is continuous with the first linking portion 121, a curved portion 122B which is continuous with the first straight portion 122A, and a second straight portion 122C which is Continuous with the curved portion 122B (see FIG. 11A).

The curved portion 122B is at a location farther from the second spring port ion 13 than the first straight portion 122A and the second straight portion 122C in the spring portion-opposed direction D2.

Further, the terminal body 11 is formed with a first auxiliary spring portion 14 and a second auxiliary spring portion 15 (see FIG. 10). The first auxiliary spring portion 14 is a spring portion which can support the first spring portion 12 from a surface side of the first spring portion 12, opposite from a surface side of the same which is brought into contact with the male terminal 20. The second auxiliary spring portion 15 is a spring portion which can support the second spring portion 13 from a surface side of the second spring portion 13, opposite from a surface side of the same which is brought into contact with the male terminal 20.

Note that the inlet portion E of the receiving portion 11D is a space (hatched area in FIG. 11B) surrounded by an end portion of the first spring portion 12 toward the terminal body (the first linking portion 121 and an end portion of the first spring body 122 toward the first linking portions in the present embodiment), and an end portion of the second spring portion 13 toward the terminal body (the second linking portion 131 and an end portion of the second spring body 132 toward the second linking portion, in the present embodiment).

When the plug connector 1 is inserted in the connector accommodation portion 80A of the receptacle connector 2, the inclined surfaces 73A of the protruding portions 73 of the plug connector 1 are brought into abutment with the protruding portion 83 of the receptacle connector 2, whereby the spring portion 72 of the plug connector 1 is elastically deformed. When the inclined surfaces 73A of the protruding portions 73 of the plug connector 1 are slid on the inclined surface 83A of the protruding portion 83 of the receptacle connector 2 until the protruding portions 73 of the plug connector 1 climb over the protruding portion 83 of the receptacle connector 2, the returning force of the spring portion 72 of the plug connector 1 restores a state of the spring portion 72 before being elastically deformed, and hence the vertical surface 83B of the protruding portion 83 of the receptacle connector 2 and the vertical surfaces 73B of the protruding portions 73 of the plug connector 1 are opposed to each other in the male terminal-inserting direction D1 (see FIG. 7). As a result, even when attempt is made to pull out the plug connector 1 from too receptacle connector 2, the vertical surfaces 73B of the protruding portions 73 of the plug connector 1 are brought into abutment with the vertical surface 83B of the protruding portion 83, which makes the ping connector 1 difficult to be pulled out of the receptacle connector 2, whereby a fitted state between the plug connector 1 and the receptacle connector 2 is maintained.

Figure 13:
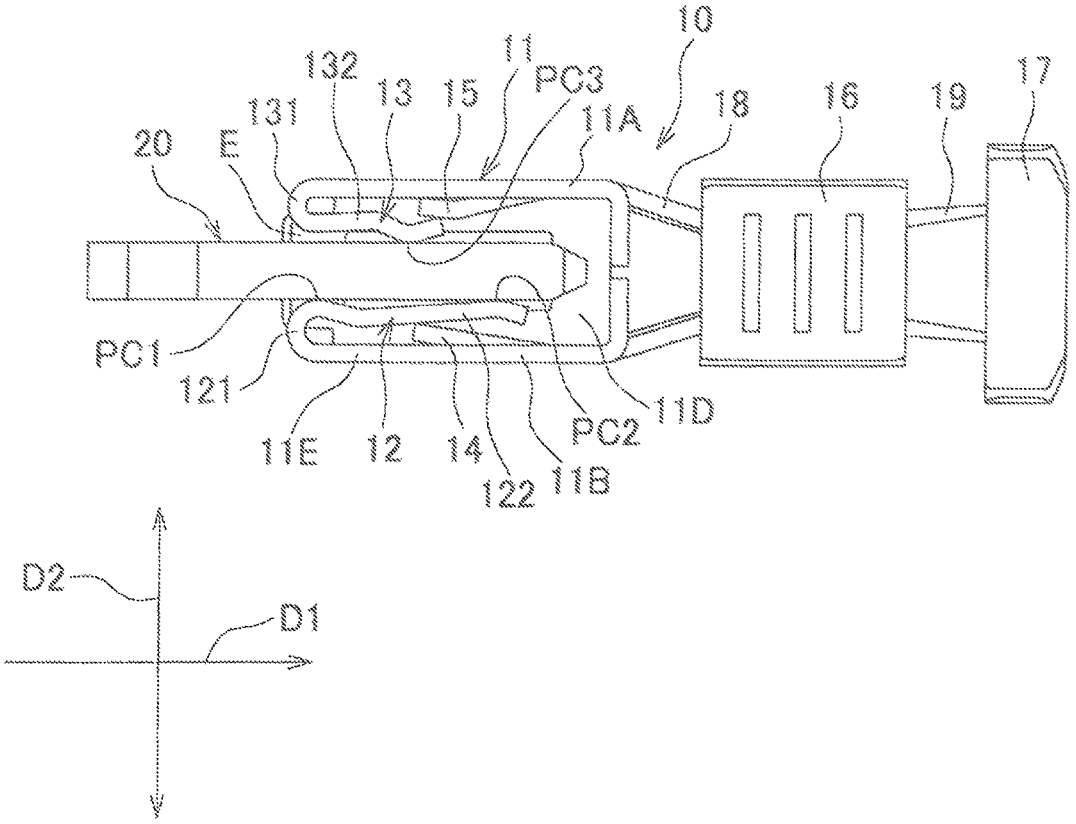
FIG. 13 is a side view of the female terminal and the male terminal, shown in FIG. 8, in a state in which the female terminal and the male terminal are fitted to each other.
Figure 14:
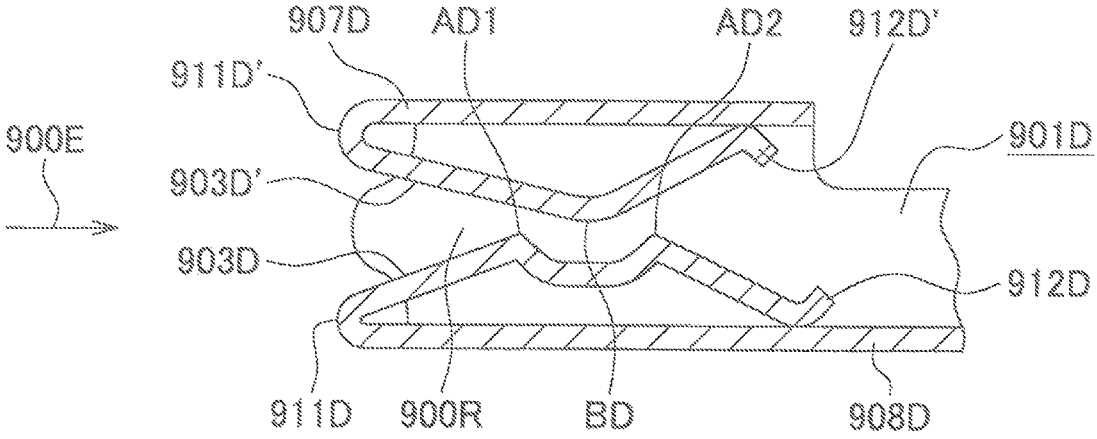
FIG. 14 PRIOR ART
FIG. 14 is a longitudinal cross-sectional view of essential parts of a conventional female terminal.

When the plug connector 1 is inserted in the connector accommodation portion 80A of the receptacle connector 2, the contact portion 21 of each sale terminal 20 of the receptacle connector 2 is relatively inserted from the inlet portion E of the receiving portion 11D of the female terminal 10 into the receiving portion 11D, whereby the first spring portion 12 and the second spring portion 13 are elastically deformed, respectively, to cause a space between the first spring portion 12 and the second spring portion 13 to be increased (see FIGS. 7 and 13). Further, when the plug connector 1 is inserted in the connector accommodation portion 80A of the receptacle connector 2, first, one of the surfaces of the contact portion 21 of each male terminal 20 la brought into contact with the first contact point PC1 of the first spring portion 12, then, the other of the surfaces of the contact portion 21 of each male terminal 20 is brought into contact with the third contact point PC3 of the second spring portion 13, and finally, the one of the surfaces of the contact portion 21 of each male terminal 20 is brought into contact with the second contact point PC2 of the first spring portion 12. Thus, the contact portion 21 of each male terminal 20 of the receptacle connector 2 is supported by the first spring portion 12 and the second spring portion 13 at the three points.

When the first spring portion 12 is elastically deformed, the first spring portion 12 presses down the first auxiliary spring portion 14, whereby the first auxiliary spring portion 14 is elastically deformed, and hence the first spring portion 12 is supported by the first auxiliary spring portion 14 from the surface of the first spring portion 12, opposite from the surface which is brought into contact with the male terminal 20, and the returning force of the first auxiliary spring portion 14 acts on one of the surfaces of the contact portion 21 of the male terminal 20 via the first spring portion 12. As a result, the contact forces applied from the first contact point PC1 and the second contact point PC2 are increased, which makes up for insufficiency of the contact force generated in a case where only the first spring portion 12 is employed.

Further, when the second spring portion 13 is elastically deformed, the second spring portion 13 presses up the second auxiliary spring portion 15, whereby the second auxiliary spring portion 15 is elastically deformed, and hence the second spring portion 13 is supported by the second auxiliary spring portion 15 from the surface of the second spring portion 13, opposite from the surface which is brought into contact with the male terminal 20, and the returning force of the second auxiliary spring portion 15 acts on the other of the surfaces of the contact portion 21 of the scale terminal 20 via the second spring portion 13. As a result, the contact force applied from the third contact point PC3 is increased, which makes up for insufficiency of the contact force generated in a case where only the second spring portion 13 is employed.

To pull out the plug connector 1 from the receptacle connector 2, it is only necessary to press down a free end portion of the spring portion 72 toward the housing body 71, and pull out the plug connector 1 from the receptacle connector 2.

When the free end portion of the spring portion 72 is pressed toward the housing body 71, a state in which the protruding portions 73 of the plug connector 1 are hooked on the protruding portion 83 of the receptacle connector 2 is released, and hence it is possible to easily pull out the plug connector 1 from the receptacle connector 21.

According to the present embodiment, since the first contact point PC1 of the first spring portion 12 is arranged at the inlet portion E of the receiving portion 11D, it is possible to arrange the second contact point PC2 of the first spring portion 12 at a location toward the inlet portion E of the receiving portion 11D, which eliminates the need of increasing the dimension of the first spring portion 12 in the male terminal-inserting direction D1. Therefore, it is possible to support the contact portion 21 of each male terminal 20 at the three points in a sandwiching manner to thereby obtain high contact stability, and it is possible to reduce the dimension of the female terminal 10 in the male terminal-inserting direction D1, and in turn realize downsizing of the plug connector 1.

Although in the above-described embodiment, the number of contact points of the first spring portion 12 is two (the first contact point PC1 and the second contact point PC2), and the number of contact points of the second spring portion 13 is one (the third contact point PC3), the number of contact points of the first spring portion 12 may be three or more, and the number of contact points of the second spring portion 13 may be two or more.

Further, although one first spring portion 12 is provided and also one second spring portion 13 is provided, two or more first spring portions 12 and two or more second spring portions 13 may be provided, or one of the number of first spring portions 12 and the number of second spring portions 13 may be one, and the other of the numbers may be two or more.

Further, although the first contact point PC1 is provided on the first linking portion 121 of the first spring portion 12, the first contact point PC1 is only required to be at a location in the inlet portion E of the receiving portion 11D, and for example, the first contact point PC1 may be provided on the end portion of the first spring body 122 of the first-spring portion 12 toward the first linking portion.

Although in the above-described embodiments the first linking portion 121 is formed into the are shape, the shape of the first linking portion 121 is not limited to the are shape but may be formed into a shape other than the arc shape, insofar as it is a shape which is bent from the receiving inlet-side end portion 11E toward the receiving portion 11D. For example, the first linking portion may be formed into a shape other than the arc shape insofar as an outer surface of the first linking portion is a curved surface which is curved from the receiving inlet-side end portion 11E toward the receiving portion 11D.

It is further -understood by those skilled in the art that the foregoing are the preferred embodiments of the present invention, and that various changes and modification may be made thereto without departing from the spirit and scope thereof.

What is claimed is:

1. A female terminal comprising:

a terminal body having a reception portion for receiving a male terminal; and a first spring portion, and a second spring portion that are formed on the terminal body, and are arranged to be opposed to each other so as to sandwich the male terminal inserted from an inlet portion of the reception portion into the reception portion, wherein the first spring portion includes:

a first linking portion which is continuous with a reception portion inlet-side end portion of the terminal body, and is bent from the reception portion inlet-side end portions toward the reception portion, and a first contact point and a second contact point which are brought into contact with the male terminal inserted in the reception portion, wherein the second spring portion includes;

a second linking portion which is continuous with the reception portion inlet-side end portion of the terminal body, and is bent from the reception portion inlet-side end portion toward the reception portion, and a third contact point which is brought into contact with the male terminal inserted in the reception portion, wherein the third contact point is at a location between the first contact point and the second contact point in a male terminal-inserting direction, wherein the first contact point is a location in the inlet portion of the reception portion, and wherein the second contact point is at a more inward location in the receiving portion than the first contact point.

2. The female terminal according to claim 1, further comprising a first auxiliary spring portion that is formed on the terminal body, and is capable of supporting the first spring portion from a surface of the first spring portion, opposite from a surface which is brought into contact with the male terminal, and a second auxiliary spring portion that is formed on the terminal body, and is capable of supporting the second spring portion from a surface of the second spring portion, opposite from a surface which is brought into contact with the male terminal.

3. The female terminal according to claim 1, wherein the female terminal is formed of one metal plate.

4. The female terminal according to claim 1, wherein the second contact point is at a location closer to the second spring portion than the first contact point in a spring portion-opposed direction in which the first spring portion and the second spring portion are opposed to each other.

5. The female terminal according to claim 4, further comprising a first auxiliary spring portion that is formed on the terminal body, and is capable of supporting the first spring portion from a surface of the first spring portion, opposite from a surface which is brought into contact with the male terminal, and a second auxiliary spring portion that is formed on the terminal body, and is capable of supporting the second spring portion from a surface of the second spring portion, opposite from a surface which is brought, into contact with the male terminal.

6. The female terminal according to claim 4, wherein the female terminal is formed of one metal plate.

7. The female terminal according to claim 1, wherein the first spring portion includes a first spring body which is continuous with the first linking portion, and extends in the male terminal-inserting direction, wherein the second spring portion includes a second spring body which is continuous with the second linking portion, and extends in the male terminal-inserting direction, wherein the first contact point is formed on the first linking portion, wherein the second contact point is formed on the first spring body, and wherein the third contact point is formed on the second spring body.

8. The female terminal according to claim 7, wherein the first spring body includes a first straight portion which is continuous with the first linking portion, a curved portion which is continuous with the first straight portion, and a second straight portion which is continuous with the curved portion, and wherein the curved portion is at a location farther from the second spring portion than the first straight portion and the second straight portion in the spring portion-opposed direction.

9. The female terminal according to claim 4, wherein the first spring portion includes a first spring body which is continuous with the first linking portion, and extends la the male terminal-inserting direction, wherein the second spring portion includes a second spring body which is continuous with the second linking portion, and extends in the male terminal-inserting direction, wherein the first contact point is formed on the first linking portion, wherein the second contact point is formed on the first spring body, and wherein the third contact point is formed on the second spring body.

10. The female terminal according to claim 9, wherein the first spring body includes a first straight portion which is continuous with the first linking portion, a curved portion which is continuous with the first straight portion, and a second straight portion which is continuous with the curved portion, and wherein the curved portion is at a location farther from the second spring portion than the first straight portion and the second straight portion in the spring portion-opposed direction.

11. The female terminal according to claim 7, wherein the first linking portion has an arc shape.

12. The female terminal according to claim 11, wherein the first spring body includes a first straight portion which is continuous with the first linking portion, a curved portion which is continuous with the first straight portion, and a second straight portion which is continuous with the curved portion, and wherein the curved portion is at a location farther from, the second spring portion than the first straight portion and the second straight portion in the spring portion-opposed direction.

13. The female terminal according to claim 9, wherein the first linking portion has an arc shape.

14. The female terminal according to claim 13, wherein the first spring body includes a first straight portion which is continuous with the first linking portion, a curved portion which is continuous with the first straight portion, and a second straight portion which is continuous with the curved portion, and wherein the curved portion is at a location farther from the second spring portion than the first straight portion and the second straight portion in the spring portion-opposed direction.

15. A connector including a female terminal comprising a terminal body having a reception portion for receiving a male terminal, and a first spring portion and a second spring portion that are formed on the terminal body, and are arranged to be opposed to each other so as to sandwich the sale terminal inserted from an inlet portion of the reception portion into the reception portion, wherein the first spring portion includes a first linking portion which is continuous with a reception portion inlet-side end portion of the terminal body, and is bent from the reception portion inlet-side end portion toward the reception portion, and a first contact point and a second contact point which are brought into contact with the male terminal inserted in the reception portion, wherein the second spring portion includes a second linking portion which is continuous with the reception portion inlet-side end portion of the terminal body, and is bent from the reception portion inlet-side end portion toward the reception portion, and a third contact point which is brought into contact with the male terminal inserted In the reception portion, wherein the third contact point is at a location between the first contact point and the second contact point in a male terminal-inserting direction, wherein the first contact point is a location in the inlet portion of the reception portion, and wherein the second contact point is at a more inward location in the receiving portion than the first contact point and, a housing that holds the female terminal.

16. The connector according to claim 15, wherein the second contact point is at a location closer to the second spring portion than the first contact point in a spring portion-opposed direction in which the first spring portion and the second spring portion are opposed to each other.

* * * * *